US005904588A

United States Patent [19]

Nimura et al.

[11] Patent Number: 5,904,588

[45] Date of Patent: May 18, 1999

[54] CONNECTOR

[75] Inventors: Kazuhiko Nimura; Masashi Saito; Hajime Okada; Hirotaka Makino, all of Yokkaichi, Japan

[73] Assignee: Sumitomo Wiring Systems, Ltd., Japan

[21] Appl. No.: 08/825,181

[22] Filed: Mar. 27, 1997

[30] Foreign Application Priority Data

Apr. 26, 1996 [JP] Japan ..... 8-108294

[51] Int. Cl.[6] ..... H01R 13/62

[52] U.S. Cl. ..... 439/301; 439/353

[58] Field of Search ..... 439/301, 353, 439/354

[56] References Cited

U.S. PATENT DOCUMENTS 5,338,211 8/1994 Kodama et al. .

5,556,295 9/1996 McFadden et al. ..... 439/353

FOREIGN PATENT DOCUMENTS 0568 030 11/1993 European Pat. Off. .

2 716 582 8/1995 France .

30 25 480 2/1982 Germany .

*Primary Examiner*—Neil Abrams

*Assistant Examiner*—Eugene G. Byrd

*Attorney, Agent, or Firm*—Banner & Witcoff, Ltd.

[57] ABSTRACT

A cover 20 is attached to connector body 10, and has a connecting and supporting member 30 engageable with a receiving member 16. Once engaged the member 30 cannot be removed. The connecting and supporting member 30 can be released only by breaking a breakable member 32. Consequently the connection of the cover 20 with the connector body 10 is maintained with certainty. In a preferred embodiment a part of the breakable member 31 is retained after breaking, this giving evidence that the cover has been removed.

24 Claims, 12 Drawing Sheets

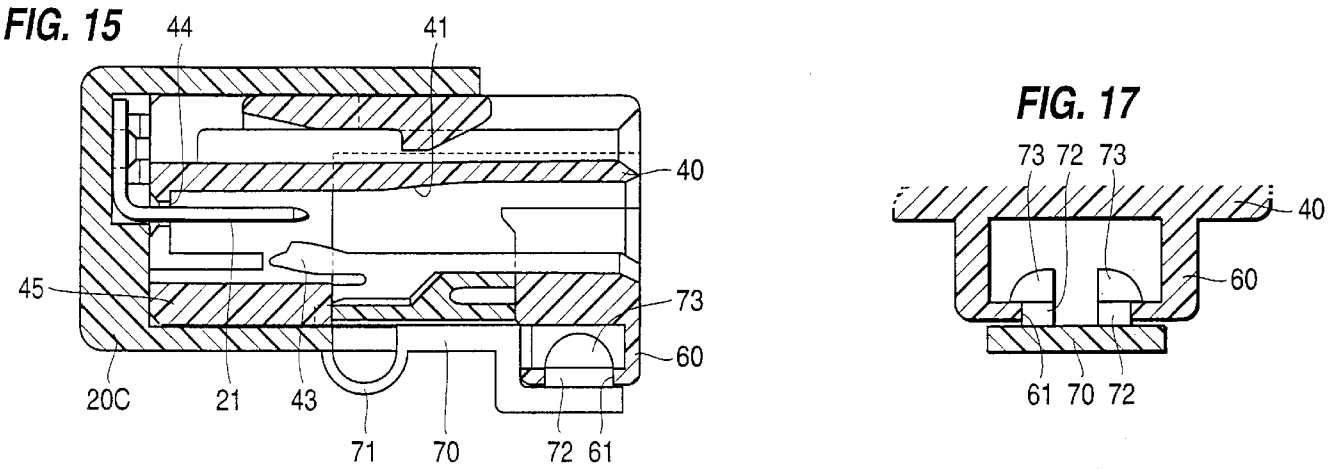
FIG. 17
FIG. 15
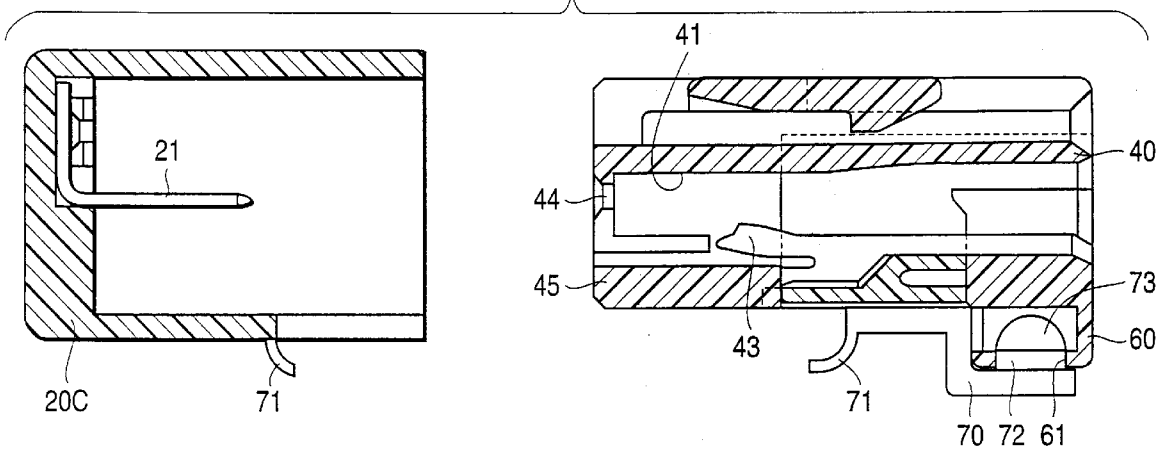
FIG. 16

CONNECTOR

FIELD OF THE INVENTION

The present invention relates to an electrical connector having a tamper evident indicator whereby the connected state of the connector can be released only by breaking a connection element.

BACKGROUND TO THE INVENTION

It is frequently the case that a tamper evident connector is required between electrical components in order to give evidence that the electrical connection has been released. Such a tamper evident connection can show unauthorised interference with an electrical connection and may also be useful in discouraging accidental disconnection.

A tamper evident connection is useful where electrical continuity must be maintained except for maintenance purposes, for example to permit a computer memory to be re-set, or a capacitive electrical storage to be deliberately discharged so as to avoid an electrical shock.

In order to, for example, start an appliance by means of a starting switch, a connector connected to a circuit on the switch side is connected to a connector connected to a circuit on the appliance side, making terminal fittings of both the connectors establish contact electrically, the appliance beginning to operate after the operation of the switch causes a starting signal to be sent.

In such a device, in the state where the connectors are in a separated state, since the terminal fittings are exposed towards the exterior along the connecting faces of the connectors, there is a possibility of foreign matter entering the interior of the female connector and of foreign matter getting attached to the male terminal fitting.

Accordingly it is desirable to cover the connecting faces of the connectors in order to protect them, and to uncover them when necessary. A cover may be envisaged that could be clamped on so as to cover the connecting faces of the connectors. However, merely clamping on the cover may be insufficiently secure. Moreover, although it is conceivable that a locking arm be provided on the cover and the locking arm be fitted to the connector so as to lock the cover thereon and to prevent separation, since in a locking means it is normally the case that a locking release operation can be carried out, there is always a possibility of the cover being separated due to deliberate or inadvertent release of the lock.

As described above, in the conventional device there is no suitable means for effecting with certainty the maintenance of an attached state of a member corresponding to a connecting portion that is connected to a terminal fitting in a connector. Taking the above problem into consideration, the present invention aims at providing a connector that can maintain with certainty an attached state of a member corresponding to a connecting portion that is connected to a terminal fitting in a connector.

SUMMARY OF THE INVENTION

According to the invention there is provided an electrical connector comprising a body having an electrical terminal, and a fitting for attachment to said body, the fitting being adapted to cover said terminal and to complete an electrical circuit through said terminal, the fitting and body having one-way latch means engageable along a latching axis whereby the fitting and body can be attached but not separated, and said latch means having a frangible connection which can be broken to permit the body and fitting to be separated thereby to break said electrical connection.

The one-way latch ensures that the terminal of the connector is shielded from exterior access by the fitting, and breakage of the latch is required in order to gain access to the terminal. In this way inadvertent access is prevented thus discouraging unauthorised interference. In addition the terminal is itself protected from entry of foreign matter and the like.

Preferably, the latch means includes retention means to retain the frangible portion thereof. This has the advantage that connection of a replacement body or fitting can be prevented because the recess is blocked. Furthermore, loose parts, which are undesirable, are prevented. Another advantage is that inspection can show whether the extension is complete, in which case it may indicate that the latch was never correctly connected this may be useful in fault finding.

The latch means may be provided on any two mating electrical connectors, or on an electrical connector and a cover therefor. In the latter case the cover may include a shorting terminal to complete an electrical circuit of the connector.

BRIEF DESCRIPTION OF THE DRAWINGS

Other aspects of the invention will be apparent from the following description of several preferred embodiment shown by way of example only in the accompanying drawings in which:

FIG. 15 is a cross-sectional view showing the connected state of embodiment 3;

FIG. 16 is a cross-sectional view showing a released state of embodiment 3;

FIG. 17 is a partial, cross-sectional view showing the details of embodiment 3;

DESCRIPTION OF PREFERRED EMBODIMENTS

Figure 1:
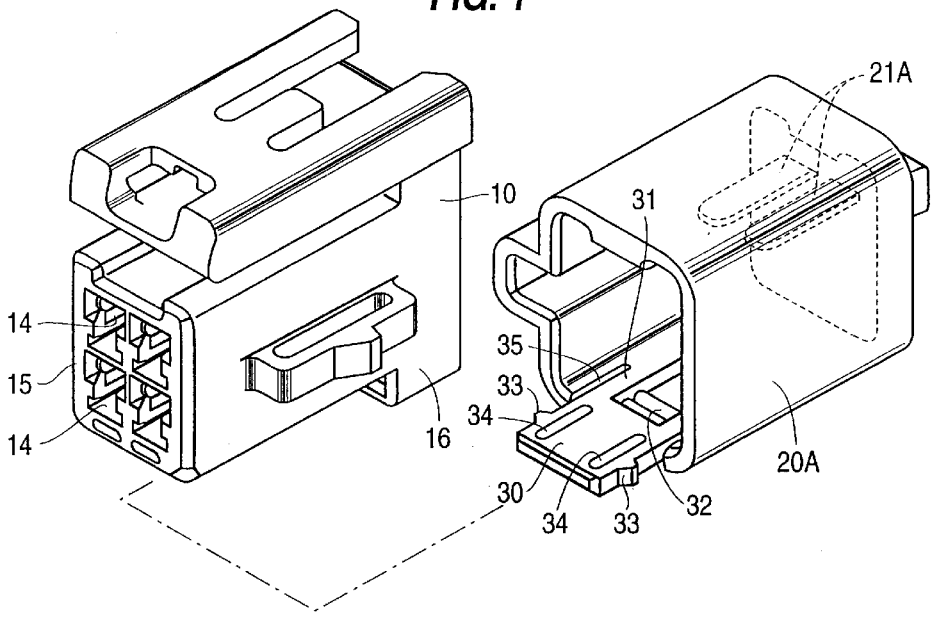
FIG. 1 is an inclined view showing a state preceding the connected state of a cover on a female housing of embodiment 1 of the present invention.
Figure 2:
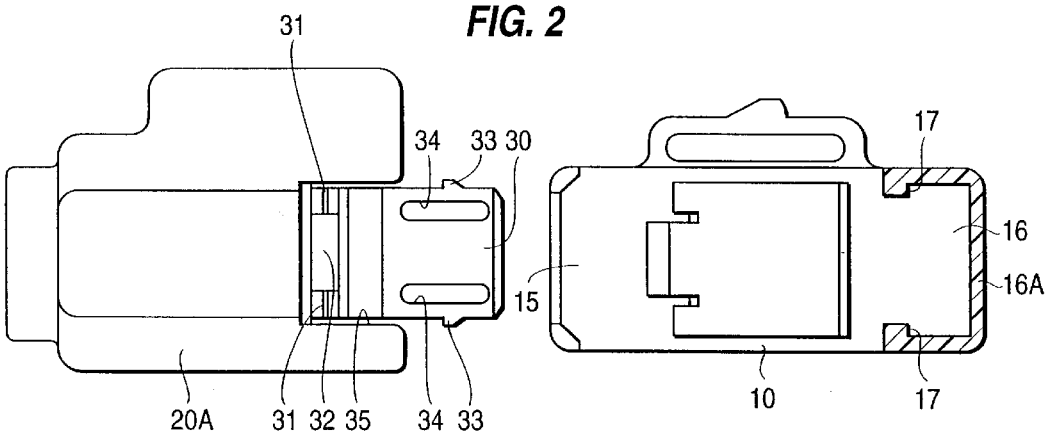
FIG. 2 is a view from below showing the components of FIG. 1.
Figure 3:
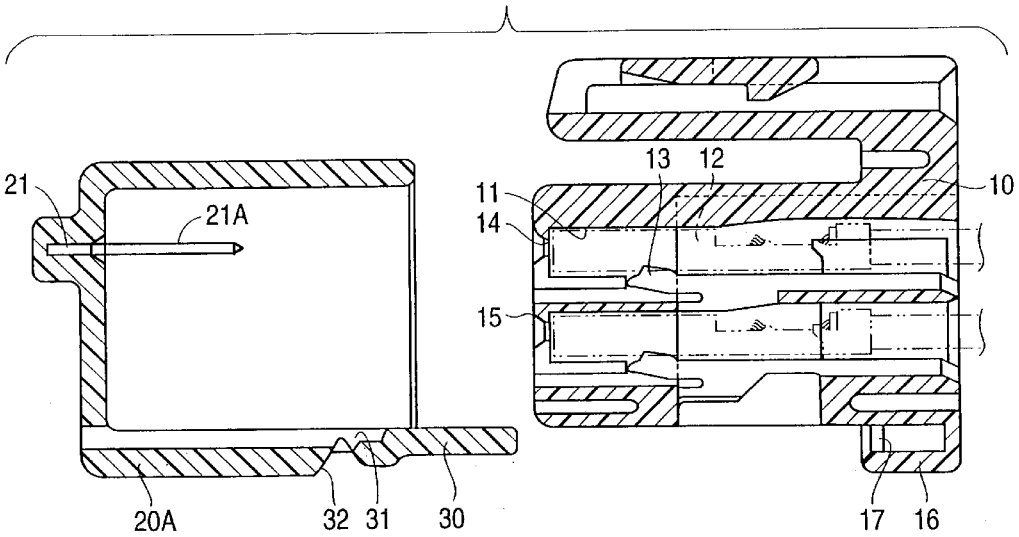
FIG. 3 is a across-sectional view showing the components of FIG. 1.
Figure 4:
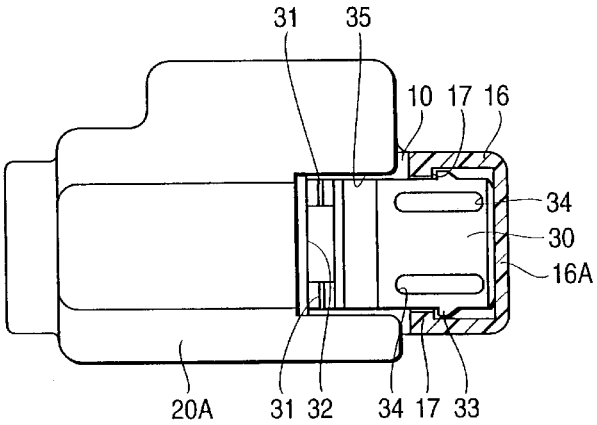
FIG. 4 is a view from below showing a connected state of the cover and the female housing of embodiment 1.
Figure 5:
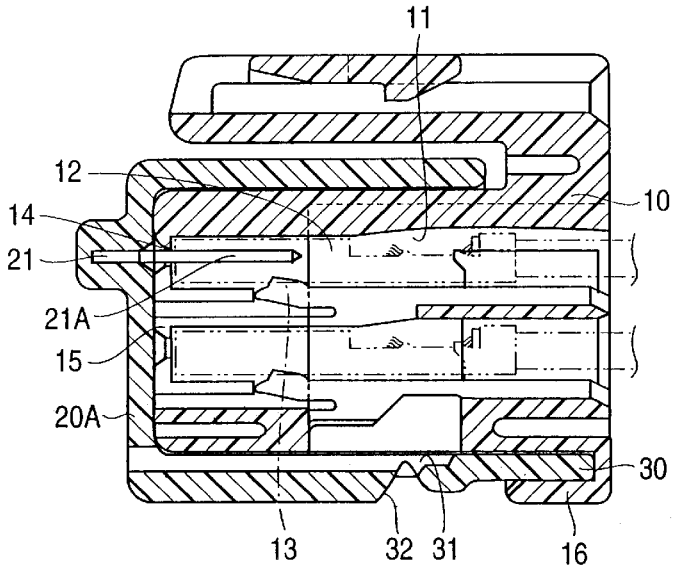
FIG. 5 is a cross-sectional view showing a connected state of the cover and the female housing of embodiment 1.
Figure 6:
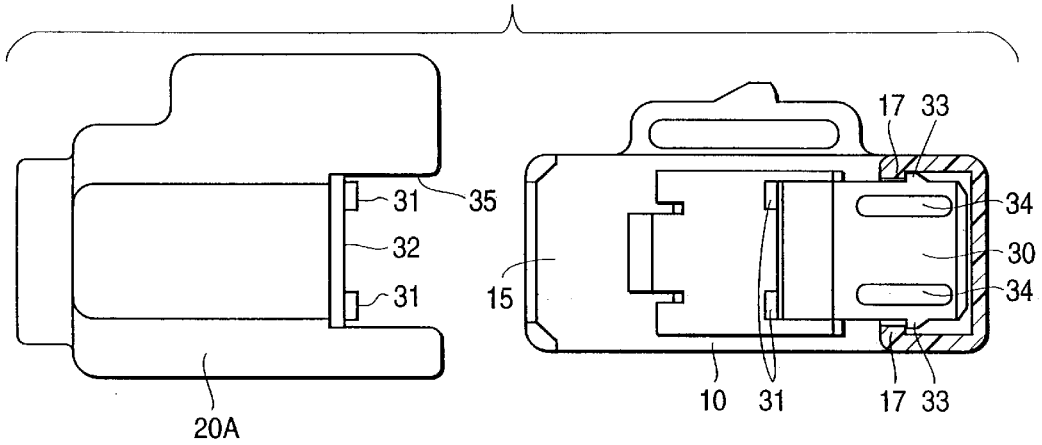
FIG. 6 is a view from below showing a released state of the cover and the female housing of embodiment 1.
Figure 7:
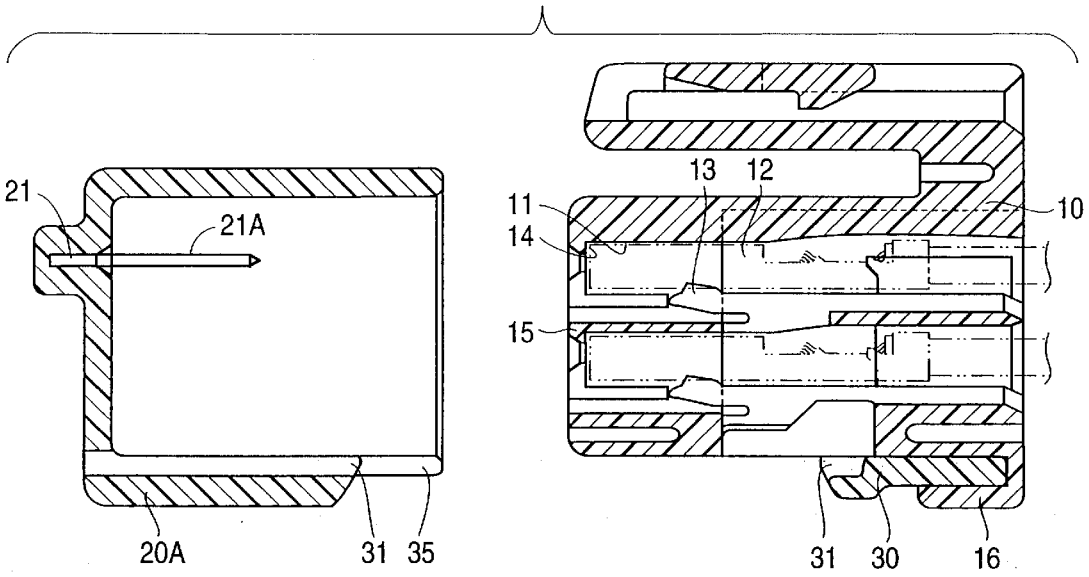
FIG. 7 is a cross-sectional view showing a released state of the cover and the female housing of embodiment 1.

Embodiment 1 of the present invention is explained hereinbelow, with reference to FIGS. 1 to 7.

A connector comprises a female connector housing 10, a cover 20A, and a connecting and supporting member 30. The female housing 10 and the cover 20A are formed as separated pieces, and the connecting and supporting member 30 is formed in a unified manner with the cover 20A.

The female housing 10 has four cavities 11 formed at two levels and arranged laterally in twos. Each cavity 11 houses a female terminal fitting 12 inserted therein from an inserting mouth located at a posterior end face of the female housing 10, the terminal fitting 12 being prevented from moving out backwards by means of the usual lance 13. The anterior end of the cavity 11 opens out to the anterior end face of the female housing 10, this opening 14 allowing the insertion of a male terminal fitting (not shown) of a corresponding connector when this corresponding connector is fitted to the female housing 10. The male terminal fitting and the female terminal fitting 12 become electrically connected when they are fitted together. The anterior end of the female housing 10 defines a connecting face 15.

The base face of the female housing 10 is substantially flat and its posterior end has a receiving member 16 to which the connecting and supporting member 30 is fitted. The receiving member 16 is box shaped and only its anterior side is open. The connecting and supporting member 30 is inserted from this open side. Inner wall faces located to the left and right of the receiving member 16 have a pair of left and right stopping members 17. These stopping members 17 are fitted with stopping protrusions 33 of the connecting and supporting member 30, thereby retaining the connecting and supporting member 30 in an unremovable position with respect to the receiving member 16, when inserted.

The cover 20A has an overall shape whereby its anterior face is open and is fitted so as to cover the connecting face 15 of the female housing 10, and the external peripheral face, thereby providing protection from the exterior.

The base plate of the cover 20A has the connecting and supporting member 30 formed in a unified manner so as to maintain the fitted state with the female housing 10. The anterior end of the base plate of the cover 20A is slotted forming a rectangular shape, and the plate shaped connecting and supporting member 30 protrudes in an overhanging manner from the inner ends of these slots 35. The inner ends of the slots 35 and the base end of the connecting and supporting member 30 are connected by means of a pair of left and right breakable members 31. These breakable members 31 are thinner than the thickness of the plate of the connecting and supporting member 30. When a tool (not shown) is inserted into tool inserting space 32 opening between the breakable members 31, the breakable members 31 are arranged to break. When these breakable members 31 break, the connecting and supporting member 30 separates from the cover 20A. Furthermore, although the breakable members 31 are thin, they have sufficient strength to support the connecting and supporting member 30 at a steady position with respect to the cover 20A, as illustrated.

In use, the protruding end of connecting and supporting member 30 enters the receiving member 16 as the cover 20A is fitted with the female housing 10. The portion inserted into the receiving member 16 has the pair of left and right stopping protrusions 33 that protrude from both side edges thereof. When these stopping protrusions 33 are inserted into the stopping members 17 of the receiving members 16, removal of the connecting and supporting member 30 from the receiving member 16 is prevented.

Moreover, the connecting and supporting member 30 has long and narrow channels 34 extending in an anterior-posterior direction along the side edges near the location of the stopping members 33. During the fitting with the receiving member 16, the stopping protrusions 33 cause the channels 34 to become narrower in width, thereby retreating inwards to permit the stopping members 17 to pass. The anterior edges of the stopping protrusions 33 are inclined with respect to the fitting direction, thereby allowing the fitting operation to be carried out smoothly.

The cover 20A has a shorting terminal 21 for short circuiting two female terminal fittings 12 located on the upper level of the female housing 10. The shorting terminal 21 has two tabs 21A protruding into the inner space of the cover 20A. When the cover 20A is in an attached state to the female housing 10, the two tabs 21A fit with the two female terminal fittings 12. Accordingly, both the female terminal fittings 12 have electrical continuity.

Next, the operation of the present embodiment is explained. When the cover 20A is attached to the female housing 10, the connecting and supporting member 30 slides along the base face of the female housing 10 as the cover 20A closes over the connecting face 15 of the female housing 10. When the cover 20A and the female housing 10 are in the correctly fitted position, the anterior member of the connecting and supporting member 30 is fitted into the receiving member 16 and the stopping protrusions 33 fit with the stopping members 17. Due to this fitting of the stopping protrusions 33 with the stopping members 17, the cover 20A and the female housing 10 are latched in the connected state. The end wall 16A is blind thus preventing removal of the broken part in the connection direction.

In this connected state, since the fitting of the stopping protrusions 33 with the stopping members 17 is carried out in a space protected from the exterior due to the receiving member 16, the fitting of the stopping protrusions 33 and the stopping members 17 cannot be released from the exterior. For example, even if a thin plate shaped member is inserted into the receiving member 16 by sliding it along the base face of the connecting and supporting member 30, since the stopping protrusions 33 are formed on the side faces, the tool cannot be moved in a fitting release direction as it is stopped by the stopping protrusion 33. Furthermore, even if a tool inserted along the side face of the connecting and supporting member 30 is twisted in a diagonal direction and an attempt made to move the stopping protrusions 33 in a fitting release direction, since the width of the slit located between the side faces of the connecting and supporting member 30 and the base plate of the cover 20A is narrow, the twisting operation of the tool cannot be carried out. Thus, even by these means the fitting of the stopping protrusions 33 and the stopping members 17 cannot be released. Moreover, even if a tool is brought to the side face of the connecting and supporting member 30 from a lateral direction by making the tool pass through the space between the anterior edge of the receiving member 16 and the anterior edge of the cover 20, since the location that this tool strikes against is distant from the stopping protrusions 33, the stopping protrusions 33 cannot be moved sufficiently. Accordingly, the engagement cannot be released and the connected state of the cover 20A with the female housing 10 is maintained.

When the connected state of the cover 20A with the female housing 10 is to be released, the breakable members 31 are broken by inserting a tool (not shown) into the tool insertion space 32. When this is done, since the connecting and supporting member 30 separates from the cover 20A, the connected state is released. Once the connection is released, the cover 20A may be separated from the female housing 10. Moreover, after removing the cover 20A from the female housing 10, since the fitting of the stopping protrusions 33 and the stopping members 17 cannot be released, the connecting and supporting member 30, which has been separated from the cover 20A, remains in the female housing 10. Thus there are no loose parts.

As described above, in the present embodiment, once the cover 20A is connected to the female housing 10, the stopping protrusions 33 of the connecting and supporting member 30 and the stopping members 17 of the female housing 10 are locked so as to be incapable of being released. Accordingly, unless the breakable members 31 are broken, the connected state cannot be released. Consequently, the connected state of the cover 20A and the female housing 10 can be maintained with certainty.

Further, in the case where the connection is released after the cover 20A has been connected to the female connector 10, the connecting and supporting member 30 invariably gets left behind in the female housing 10. Consequently, if one confirms whether the connecting and supporting member 30 has been left behind in the female housing 10 in the separated state of the cover 20A and the female housing 10, it becomes possible to determine whether the cover 20A has been separated after having been previously attached, or was in an unconnected state from the outset.

Furthermore, since the cover 20A is attached so as to cover the connecting face 15 of the female housing 10, the opening 14 of the cavity 11 located at the anterior end face of the female housing 10 is protected from the exterior, and the protection from the exterior extends to the anterior peripheral face of the anterior end of the female housing 10. Consequently, the entry of foreign matter into the cavity 11 from the opening 14 is prevented with certainty.

Moreover, in the state where the cover 20A is attached to the female housing 10, since the shorting terminal 21 provided in the cover 20A fits with the terminal fittings and short circuits these female terminal fittings 12, the circuit connected to the female housing 10 is in an electrically stable state.

Figure 10:
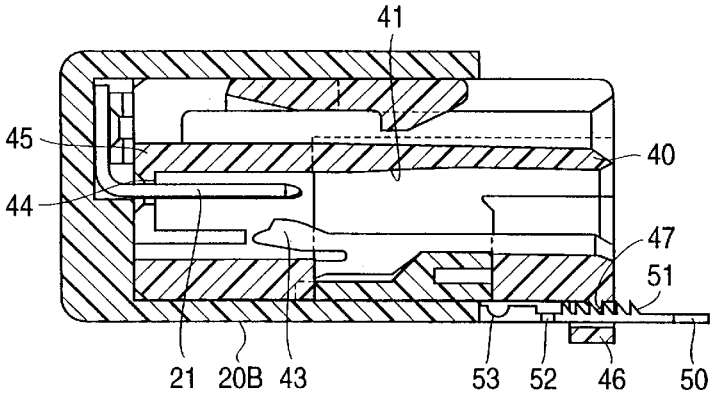
FIG. 10 is a cross-sectional view showing a connected state of the cover and the female housing of embodiment 2.
Figure 8:
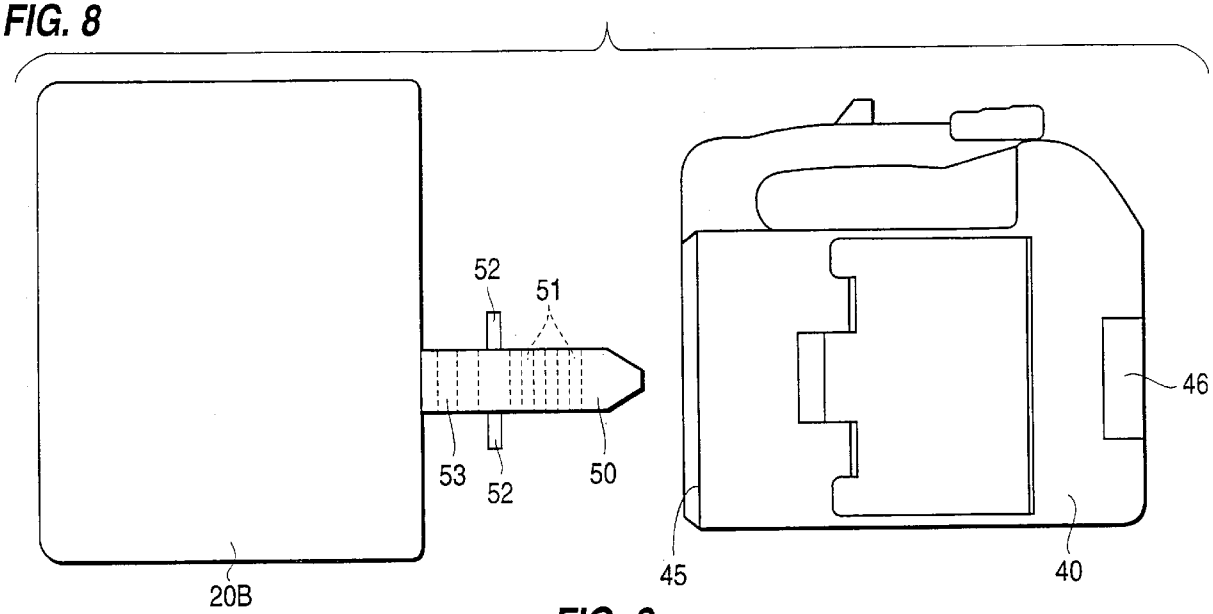
FIG. 8 is a view from below showing a state preceding the connected state of the cover and the female housing of embodiment 2 of the present invention.
Figure 9:
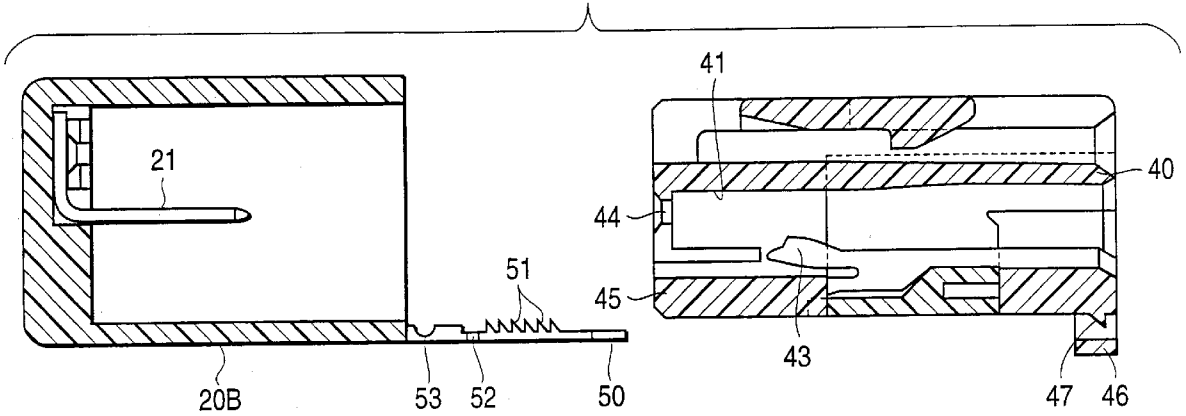
FIG. 9 is a cross-sectional view of the components of FIG. 8.
Figure 11:
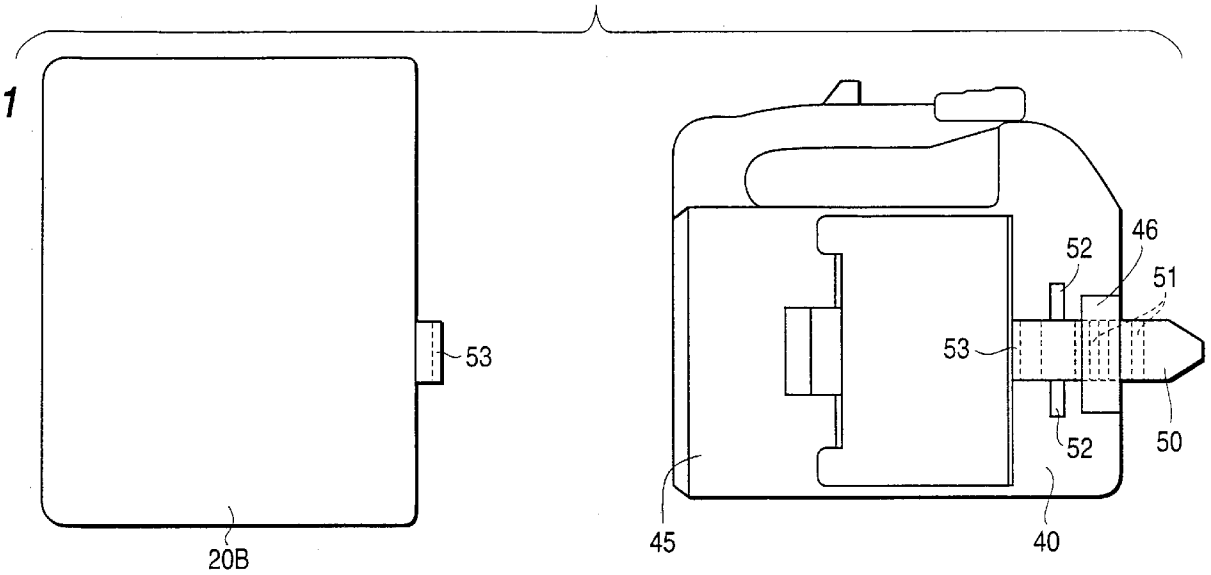
FIG. 11 is a view from below showing a released state of embodiment 2.
Figure 12:
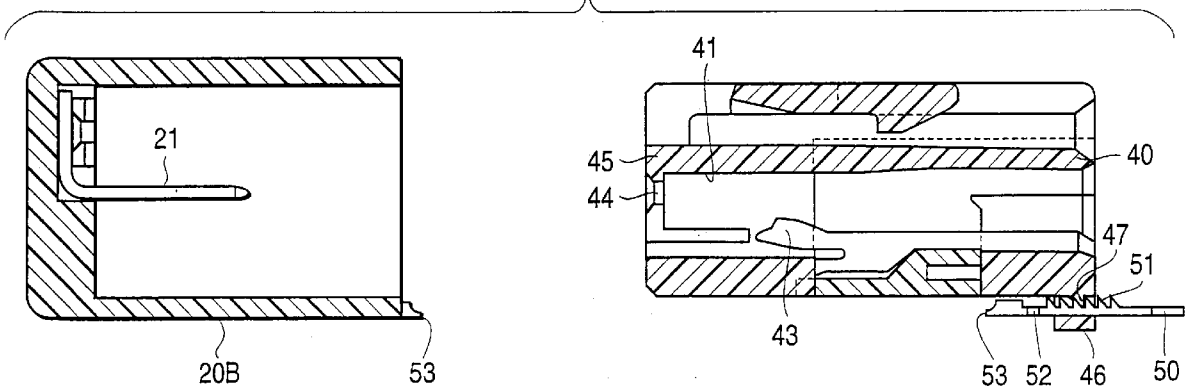
FIG. 12 is a cross-sectional view showing the released state of embodiment 2.

Next, embodiment 2 of the present invention is explained hereinbelow, with reference to FIGS. 8 to 12.

The present embodiment differs from embodiment 1 with respect to the connection configuration of a cover 20B and a female housing 40, and with respect to the configuration of the female housing 40. Since embodiment 2 is the same as embodiment 1 in all other respects, the same number as in embodiment 1 is accorded to each similar part and an explanation of the configuration, operation and effect thereof is omitted. Moreover, although a portion of the cover 20B differs from the cover 20A in embodiment 1, the basic configuration is the same. Accordingly, the same number is accorded to the cover 20B and an explanation thereof is omitted.

In the female housing 40 of the present embodiment, two cavities 41 are formed so as to be laterally aligned. Each cavity 41 houses a female terminal fitting (not shown) inserted therein from an inserting mouth located at the posterior end face of the female housing 40, the terminal fitting being prevented from moving out backwards by means of a lance 43. The anterior end of the cavity 41 opens out to the anterior end face of the female housing 40, this opening 44 allowing the insertion of a male terminal fitting (not shown) of a corresponding connector when this corresponding connector (not shown) is fitted with the female housing 40. The anterior end of the female housing 40 corresponds to a connection face 45 located towards the terminal fitting.

The base face of the female housing 40 is flat in shape and its posterior end has a receiving member 46 formed thereon. The receiving member 46 has a bridge shape and extends in the left-right direction. A connecting and supporting member 50 is attached to the receiving member 46 so as to be removable. The receiving member 46 has a stopping member 47 formed thereon so as to protrude from the base face of the female housing 40. The stopping member 47 extends in the left-right direction and forms the shape of a right angled triangle when seen in cross-section. The anterior face of the stopping member 47 (the side facing the connecting and supporting member 50) is inclined with respect to the insertion direction of the connecting and supporting member 50 in order to make the insertion of the connecting and supporting member 50 easier. The posterior face forms a right angle with respect to the insertion direction of the connecting and supporting member 50 in order to abut stopping protrusions 61 of the connecting and supporting member 50. Due to the abutment of the stopping protrusions 51 with the stopping member 47, the movement of the connecting and supporting member 50 from the receiving member 46 in the removal direction is prevented.

The overall configuration of the cover 20B is the same as that of embodiment 1, and so its explanation is omitted. The connecting and supporting member 50 is provided on the cover 20B in a unified manner. The connecting and supporting member 50 has a belt shape and protrudes in an anterior direction from the anterior end of the base plate member of the cover 20B. Its upper face (the face facing the base face of the female housing 40) has a plurality of stopping protrusions 51 formed at a constant pitch. These stopping protrusions 51 are shaped so as to form right angled triangles when seen cross-sectionally, as is the stopping member 47, the anterior faces being inclined with respect to the direction of insertion into the receiving member 46 so as to make the stopping member 47 pass over these easily. The posterior faces form a right angles shape in order to make the abutment with the stopping member 47 certain.

Further, a pair of left-right wing members 52 are formed in a location closer to the case end than to the stopping protrusions 51, the wing members 52 protruding from both the side faces. These wing members 52 are located in such a position as to permit contact with the anterior end faces of the receiving member 46 when the stoping protrusions 51 are in a fitted state with the stopping members 47.

A breakable member 53 is formed in a location closer to the base end than to the wing members 52, the breakable member 53 being thinned off in a spherical shape on the upper face thereof. This breakable member 53 has a space for allowing the insertion of a tool (not shown) from under the base face of the female housing 40 when the cover 20B is connected to the female housing 40. When the tool is inserted into this space and is twisted, the breakable member 53 is arranged to break. Furthermore, although the breakable member 51 is arranged to be thin, it has sufficient strength to support the connecting and supporting member 50 with respect to the cover 20B.

Next, the operation of the present embodiment is described. When the connecting and supporting member 50 is slid along the base face of the female housing 40 and the cover 20B made to cover the connecting member 45 of the female housing 40, the anterior and of the connecting and supporting member 50 passes through the interior of the receiving member 46, and the stopping protrusions 51 are engaged by the stopping member 47. Due to the fitting of the stopping protrusions 51 with the stopping member 47, the cover 20B and the female housing 40 is latched in a connected state.

In this connected state, since the fitting of the stopping protrusions 51 with the stopping member 47 is carried out in a space protected from the exterior by the receiving member 46, the fitting of the stopping protrusions 51 with the stopping member 47 is impossible to release from the exterior.

When the connected state of the cover 20B and the female connector 40 is to be released, a tool (not shown) is inserted into the space between the breakable member 53 and the base face of the female housing 40, thereby breaking the breakable member 53. When this is done, the connecting and supporting member 50 separates from the cover 20B, releasing the connected state. When the connected state is released, the cover 20B can be removed from the female housing 40.

Moreover, the connecting and supporting member 50, which has been separated from the cover 20B, is prevented from moving in the removal direction due to the fitting of the stopping protrusions 51 and the stopping member 47. Furthermore, even if an attempt is made to pull the connecting and supporting member 51 in a removal direction, the wing members 52 make contact with the anterior ends of the receiving member 46, thereby preventing removal. Consequently, the connecting and supporting member 50 cannot be removed from the receiving member 46 and is left behind in the female housing 40.

In this way, as in embodiment 1, the connected state of the cover 20B and the female housing 40 can be maintained with certainty; due to the presence or absence of the connecting and supporting member 50 in the female housing 40 it becomes possible to decide whether the cover 20B was previously attached to the female housing 40. Furthermore, the entry of foreign matter from the opening member 44 into the cavity 41 is prevented.

Figure 13:
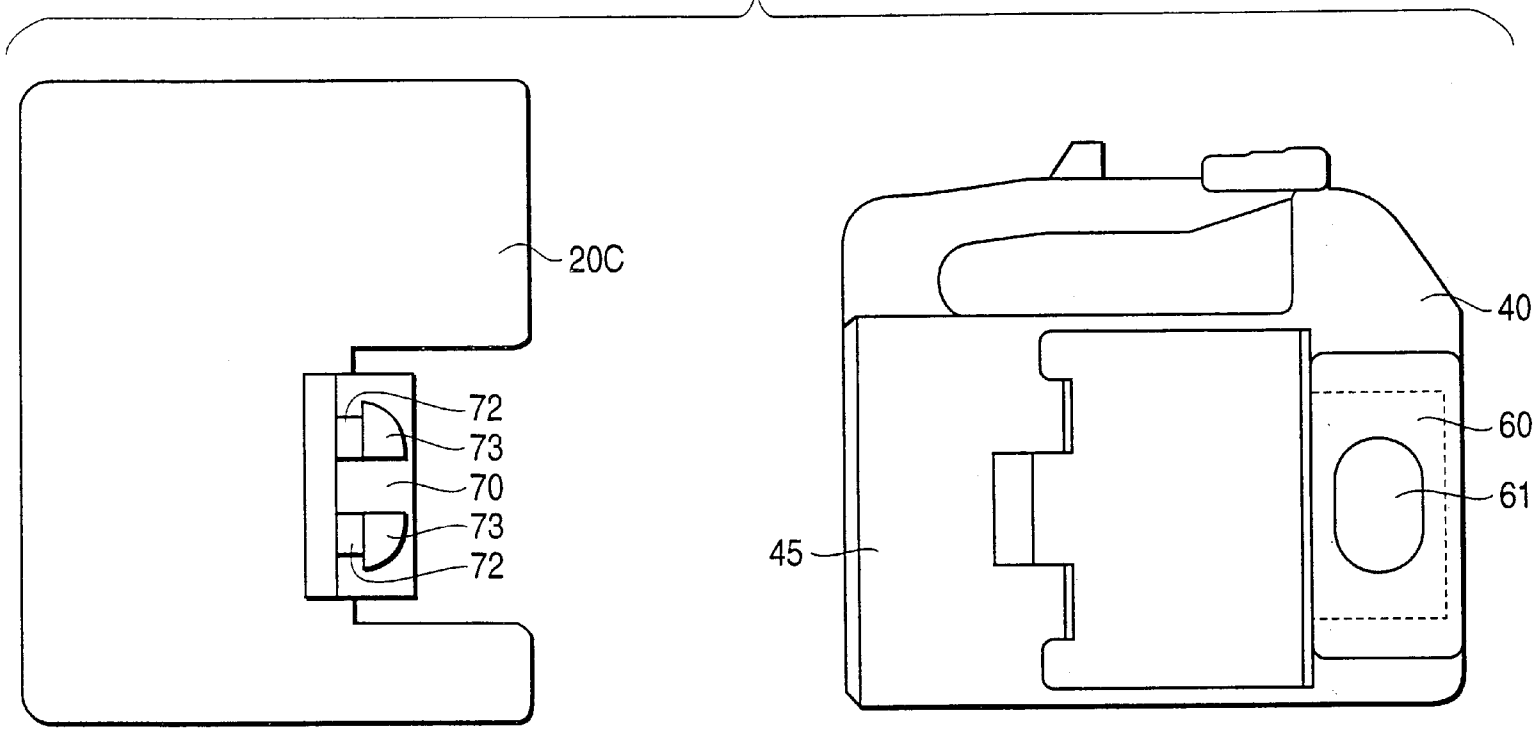
FIG. 13 is a view from below showing a state preceding the connected state of the cover and the female housing of embodiment 3.
Figure 14:
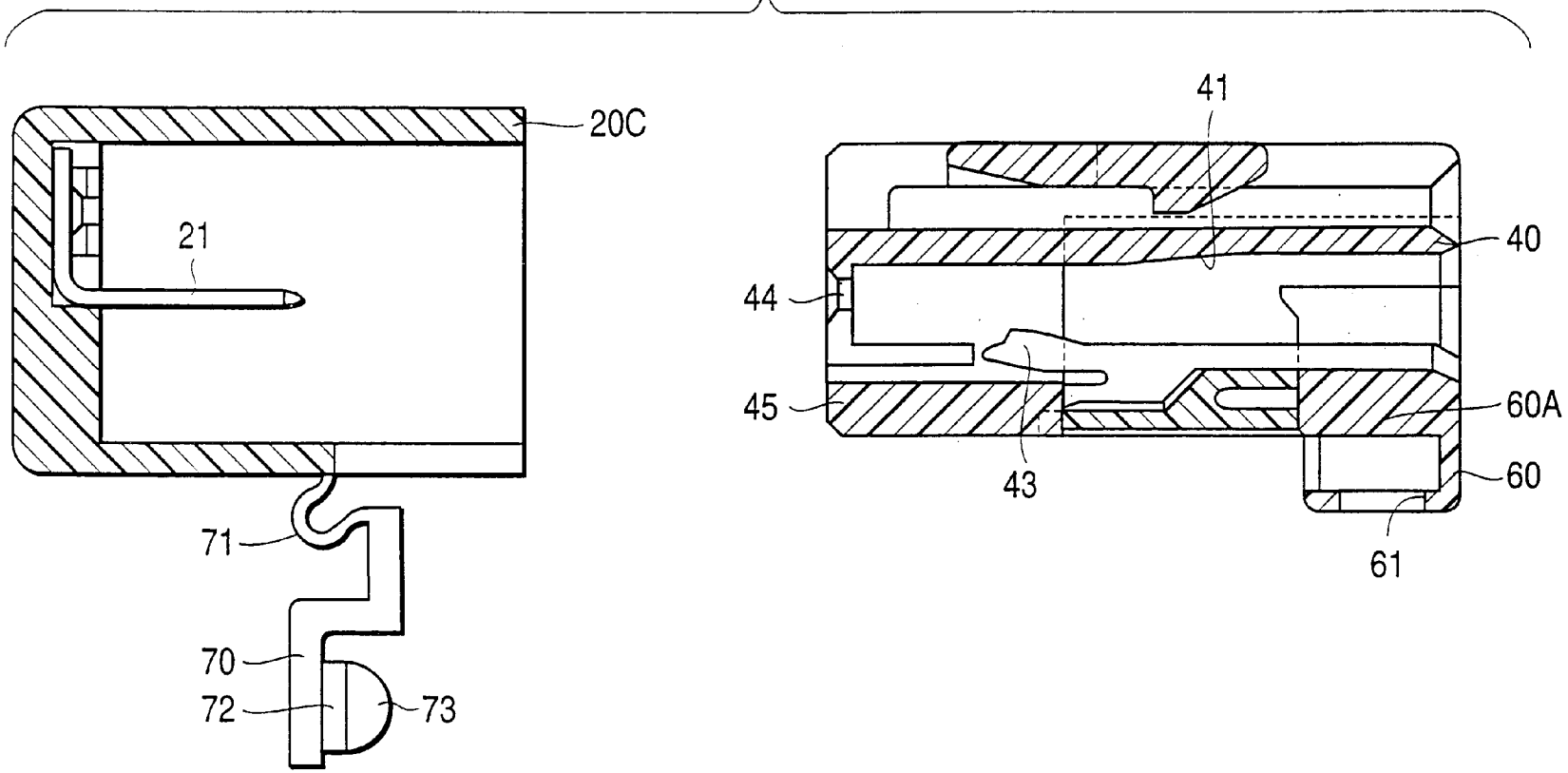
FIG. 14 is a cross-sectional view showing the components of FIG. 13.

Next, embodiment 3 of the present invention is explained hereinbelow, with reference to FIGS. 13 to 17. The present embodiment differs from embodiment 2 with respect to the connection configuration of a cover 20C and a female housing 40. Since embodiment 3 is the same as embodiment 2 in all other respects, the same number as in embodiment 2 is accorded to each similar part and an explanation of the configuration, operation and effect thereof is omitted.

The posterior end of the base face of the female housing 40 has a box shaped receiving member 60 which has a hole opened out on its anterior face. This receiving member 60 has a fitting hole 61 which is elliptical in shape and opens out towards the base face. The base plate of the cover 20C has a connecting and supporting member 70 formed in a unified manner via a hinge shaped breakable member 71. The breakable member 71 is thin and easily bendable. The anterior end of the connecting and supporting member 70 has a pair of protruding foot members 72 which form a semi-circular shape so as to fit with the semi-circular edges of the fitting hole 61. The protruding end of each foot member 72 has a schematically quarter-circle shaped stopping protrusion 73. The foot member 72 is bendable inwards, and due to this bending capability the stopping protrusions 73 can pass by the edges of the hole of the fitting hole 51.

Next, the operation of the present embodiment is explained. After the cover 20C is fitted to the female housing 40 so as to cover a connecting member 45, the connecting and supporting member 70 is fitted with the receiving member 60 by pushing it from underneath. When this is done, the stopping protrusions 73 pass through the fitting hole 61 and come to be housed in the receiving member 60, and are stopped by edges of the fitting hole 61. Accordingly, the connecting and supporting member 70 becomes unremovable with respect to the receiving member 60, and the cover 20C and the female housing 40 is latched in a connected state. In the connected state, since the fitting of the stopping protrusions 73 and the fitting hole 61 occurs in a space protected from the exterior by the receiving member at 60A, the fitting of the stopping protrusions 73 in the hole 61 cannot be released from the exterior. Accordingly, the connected state of the cover 20C and the female housing 40 is maintained.

When the connected state of the cover 20C and the female housing 40 is to be released, a tool (not shown) is inserted into the space between the breakable member 71 and the base face of the female housing 40 and the breakable member 71 is broken, thereby separating the cover 20C from the connecting and supporting member 70. Further, the connecting and supporting member 70, which has been separated from the cover 20C, gets left behind in the female housing 40 due to fitting of the fitting protrusions 73 in the fitting hole 61.

Figure 18:
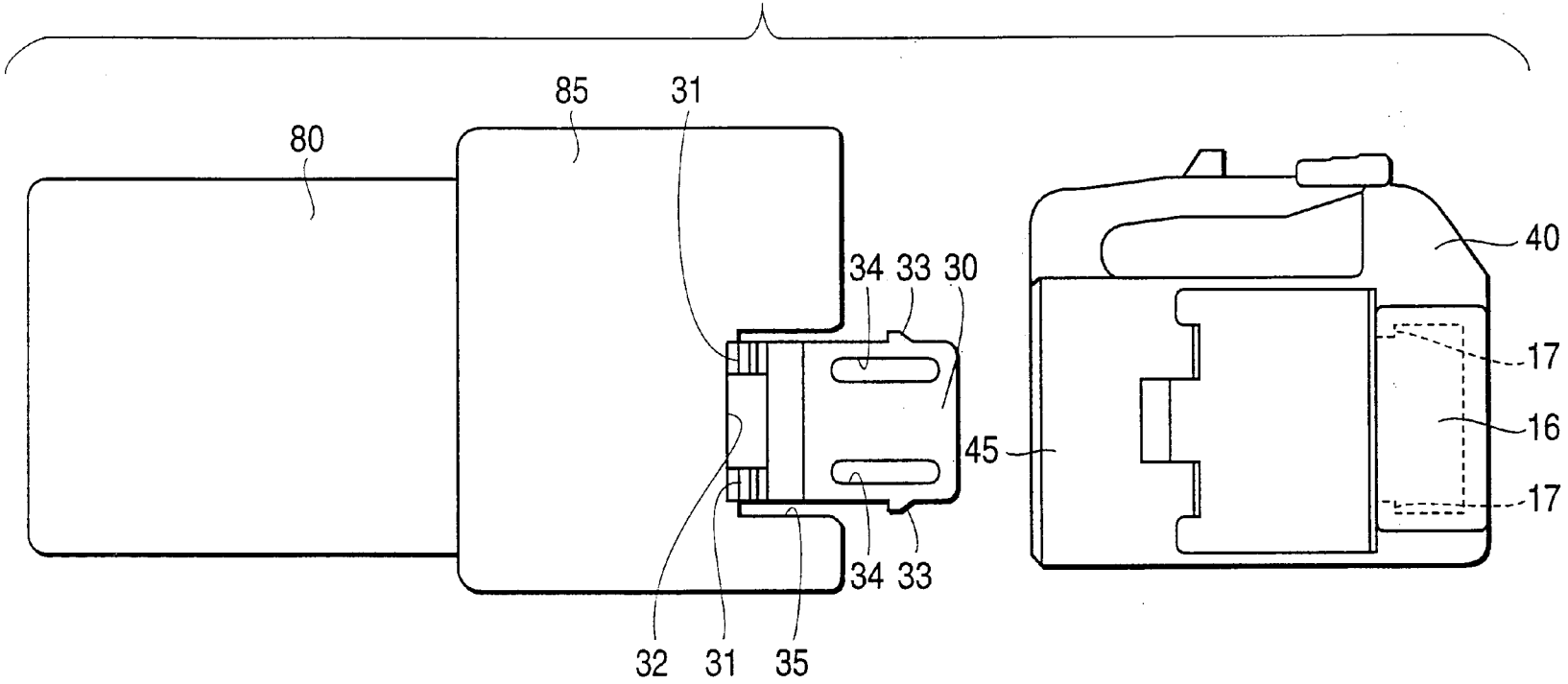
FIG. 18 is a view from below showing a state preceding the connected state of the male housing with the female housing of embodiment 4.
Figure 19:
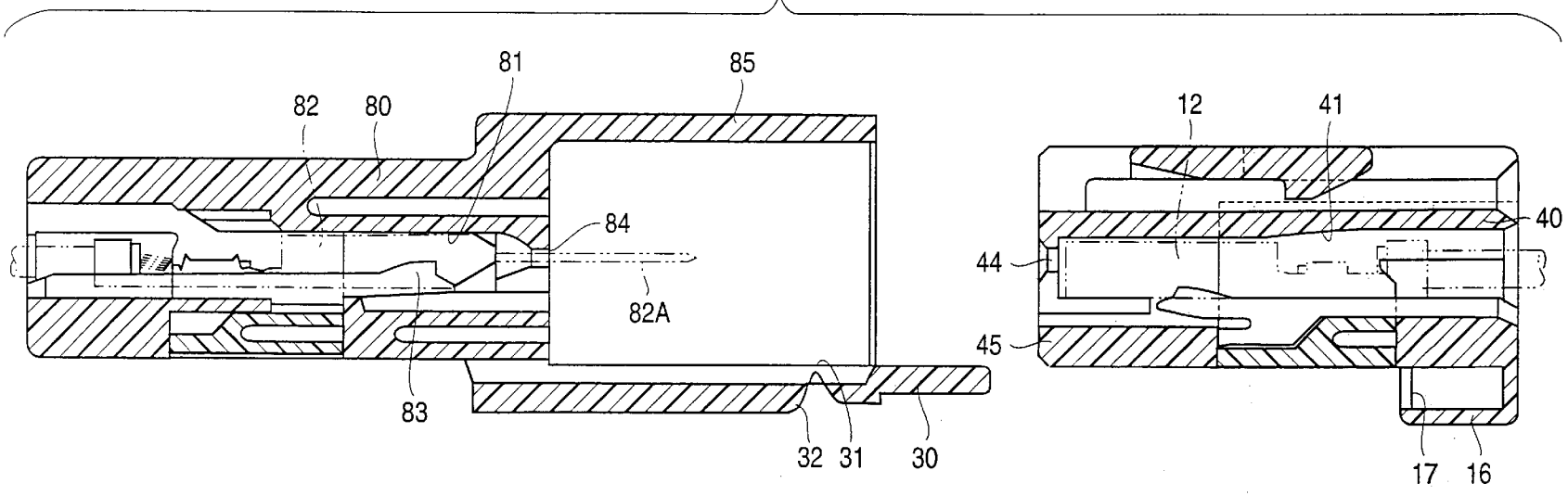
FIG. 19 is a cross-sectional view showing the components of embodiment 4.
Figure 20:
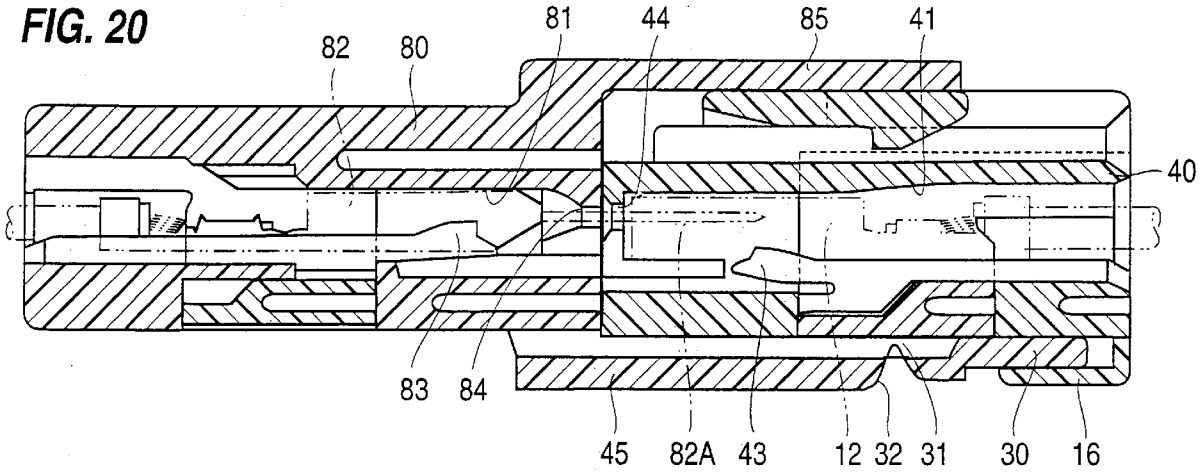
FIG. 20 is a cross-sectional view showing the connected state of embodiment 4.
Figure 21:
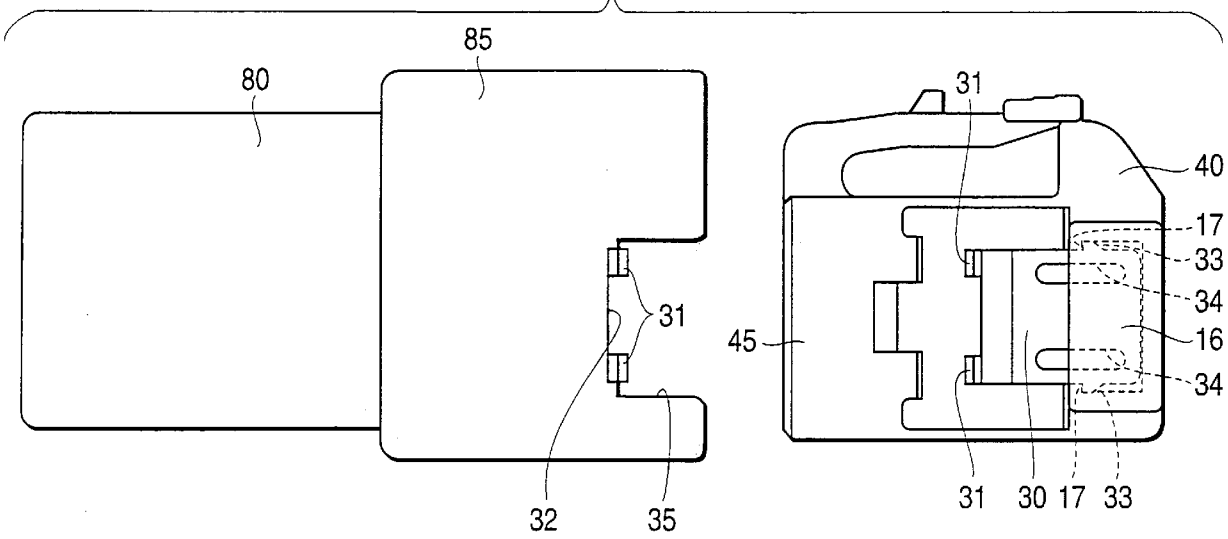
FIG. 21 is a view from below showing a released state of embodiment 4.

Next, embodiment 4 of the present invention is explained hereinbelow, with reference to FIGS. 18 to 21. In the present embodiment, it is a male connector housing 80 (hereinafter referred to as the male housing) that is connected to a female housing (connector body). Moreover, a female housing 40 of the present embodiment is the same as that of embodiment 2 and embodiment 3, and since the connection configuration of the male housing 80 and the female housing 40 is the same as that in embodiment 1, the same number as in embodiment 1 is accorded to each similar part and an explanation of the configuration, operation and effect thereof is omitted.

Two cavities 81 are formed so as to be laterally aligned in the male housing 80. Each cavity 81 houses terminal fitting 82 inserted therein from an inserting mouth located at the posterior end face of the male housing 80 the terminal fitting 82 being prevented from moving out backwards by means of a lance 83. A male tab 82A protrudes into a hood member 85 from an opening 84 located at the anterior end of the cavity 61. The male housing 80 is fitted so that its hood member 85 covers the connecting member 45 of the female housing 40.

This male housing 80 has a connecting and supporting member 30 formed so as to protrude anteriorly from the base plate of the hood member 85. The connecting and supporting member 30 has the same configuration as the connecting and supporting member 30 of embodiment 1, and is provided with a pair of left and right stopping protrusions 33 and a pair of left and right breakable members 31. The female housing 40 has a receiving member 16 which has the same configuration as the receiving member 16 of embodiment 1, stopping members 17 being formed in the receiving member 16, the stopping members 17 fitting with the stopping protrusions 33.

When the male housing 80 is fitted with the female housing 40, the male tab 82A fits with the female terminal fitting 12 and the female and male terminal fittings 12 and 82 are connected. Further, the connecting member 45 of the female housing 40 comes to be protected from the exterior by the hood member 85 and the entry of foreign matter is prevented. As the fitting operation of the male housing 80 and the female housing 40 proceeds, the connecting and supporting member 30 enters the receiving member 16 and the stopping members 17 and the stopping protrusions 33 fit together. As a result, the male housing 80 and the female housing 40 are maintained in a connected state. In the connected state, since the fitting of the stopping protrusions 33 with the stopping members 17 cannot be released from the exterior, the connected state is maintained with certainty.

When the connection is to be released, the breakable member 31 is broken and the connecting and supporting member 30 is separated from the male housing 80. The separated connecting and supporting member 30 gets left behind in the female housing 40 in a fitted state with the receiving member 16.

In this way, in the present embodiment as well as in the case of embodiment 1, the connected state of the male housing 80 with the female housing 40 can be maintained with certainty. At the same time, whether the male housing 80 was ever connected previously to the female housing 40 or not can be determined by the presence or absence of the connecting and supporting member 80 in the female housing 40. Moreover, the entry of foreign matter into the cavity 81 from the opening member 44 can be prevented with certainty.

The present invention is not limited to the embodiments described above with the aid of figures. For example, the possibilities described below also lie within the technical range of the present invention. Moreover, the present invention may be embodied in various ways other than those described below without deviating from the scope thereof.

1) In the above embodiment, it is arranged so that when the connecting and supporting member is broken and the connection is released, a remaining portion of the connecting and supporting member is left behind in the connector body. However, it may equally be arranged so that during the release of the connection the remaining portion of the connecting and supporting member is not retained in the connector body.

2) In the above embodiment, the connecting and supporting member is arranged to be formed on a unified manner in the corresponding connecting body. However, it may equally be arranged so that the connecting and supporting member is formed in a unified manner with the connector body. In such a case, when the connection is released by breaking the connecting and supporting member, since its broken portion gets left behind, even in the case where the connecting member of the connector body is in a released state, it becomes possible to determine by confirming the presence or absence of the broken portion, whether the corresponding connecting member was previously ever connected.

3) It may equally be arranged so that the connecting and supporting member, the connector body and corresponding connecting body are mutually separate pieces. In such a case, the portion of the connection supporting member remaining behind when the connection is released may either be arranged to be left behind in the corresponding connecting body or to not be left behind.

4) It may equally be arranged so that the connecting and supporting member is formed in a unified manner with the connector body, and so that in the corresponding connecting body as well a separate connecting and supporting member is formed in a unified manner, these connecting and supporting members connecting respectively with the corresponding connecting body and the connector body.

5) It may equally be arranged so that the connecting and supporting members are formed in a unified manner with both the connector body and the corresponding connecting body, so that when the connector body and the corresponding connecting body are connected, both the connecting and supporting members are engaged so as to be non-separable, thereby maintaining the connected state.

6) The fitting configuration of the connecting and supporting member with the connector body need not be limited to that described in the above embodiments; as long as it is arranged so that once the fitting has been effected, a fitting release operation from the exterior becomes impossible.

7) In the above embodiments, although a case was described where the connector body is a female connector, the present invention also applies in the case where the connector body is a male connector.

8) In embodiments 1 to 3, it may equally be arranged that there is no shorting terminal in the cover.

We claim:

1. An electrical connector comprising a body having an electrical terminal accessible from the exterior thereof and a first latch element integrally formed with the body, and a fitting for attachment to said body, the fitting being adapted to cover said terminal to prevent access thereto and to complete an electrical circuit through said terminal, the fitting having a second latch element integrally formed with the fitting for coupling with said first latch element to form a one-way latch engageable along a latching axis whereby the fitting and the body can be attached but not separated, and one of said latch elements having a frangible connection which can be broken to permit the body and fitting to be separated to break said electrical circuit.

2. A connector according to claim 1 wherein one of said first and second elements comprises an elongate extension having a base end and an opposite free end, and the other of said first and second latch elements includes a recess for receiving the extension, the free end of said extension defining a one-way latch member and the base of said extension defining said frangible connection.

3. A connector according to claim 2 wherein said latch further includes retention means to retain and prevent removal of the free end of said extension in said recess after breakage of said frangible connection.

4. A connector according to claim 2 wherein said frangible connection comprises a thinned part of said extension.

5. A connector according to claim 2 wherein said extension is a close fit in said recess, said recess defining an abutment surface and said extension having a protrusion for snap fitting engagement with said abutment surface.

6. A connector according to claim 5 wherein one of said extension and recess has an angled ramp face to ensure progressive smooth engagement of said protrusion with said abutment surface when latching.

7. A connector according to claim 2 wherein said extension comprises a substantially planar projection having opposite lateral protrusions substantially perpendicular to said latching axis, the recess having opposite abutments for engagement by said protrusions.

8. A connector according to claim 7 wherein said recess is blind.

9. A connector according to claim 2 wherein said extension comprises a strip-like projection having a plurality of axially aligned, upstanding teeth substantially perpendicular to said latching axis and adapted for sequential engagement with an abutment surface of said recess.

10. A connector according to claim 9 where said teeth are substantially triangular, each having a sloping front face and a rear face perpendicular to the latching axis.

11. A connector according to claim 9 wherein said projection includes a laterally extending arm between said free end and said frangible connection, said arm being adapted to abut a mouth of said recess to limit the insertion depth of said projection and prevent removal of the projection from said recess after breaking said frangible connection.

12. A connector according to claim 11 wherein opposite lateral arms are provided substantially perpendicular to said teeth.

13. A connector according to claim 2 wherein said extension comprises a latching member having oppositely directed protrusions for engagement with opposite abutment surfaces of said recess, said latching member being connected to a respective one of said body and fitting by a flexible strap.

14. A connector according to claim 13 wherein said strap comprises said frangible connection.

15. A connector according to claim 13 wherein said recess comprises an aperture in a wall of one of the body and fitting.

16. A connector according to claim 1 wherein said fitting comprises a cover for said body, the cover being tubular and having one end substantially closed to prevent external access to said electrical terminal.

17. A connector according to claim 16 wherein said body includes two electrical terminals and said fitting includes a shorting terminal for connection thereto.

18. A connector according to claim 1 wherein said one-way latch comprises a projection of said body and a mating recess of said fitting, the recess defining an abutment and the projection having a series of ratchet teeth for progressive engagement with said abutment.

19. A connector according to claim 18 wherein said recess is blind.

20. A connector according to claim 19 wherein said abutment is defined by the mouth of said recess.

21. A connector according to claim 1 wherein one of said first and second latch elements includes a retainer which prevents decoupling of said latch elements after breaking of said frangible connection.

22. A connector according to claim 21 wherein one of said first and second latch elements includes an extension with at least one projection and the other of said first and second latch elements includes a recess with at least one abutment engageable with said projection.

23. A connector according to claim 22 wherein said retainer includes a laterally extending arm on said extension between said frangible connection and the free end which cannot pass through said recess.

24. A connector according to claim 22 wherein said retainer includes a wall on said recess to enclose one end of the recess whereby the portion of the extension received in said recess is not accessible.

* * * * *